US009245685B2

(12) United States Patent
Cho et al.

(10) Patent No.: US 9,245,685 B2
(45) Date of Patent: Jan. 26, 2016

(54) COMMON MODE FILTER AND METHOD OF MANUFACTURING THE SAME

(71) Applicant: SAMSUNG ELECTRO-MECHANICS CO., LTD., Suwon-si, Gyeonggi-do (KR)

(72) Inventors: Jeong Min Cho, Gyeonggi-do (KR); Sung Kwon Wi, Gyeonggi-do (KR); Chan Yoon, Gyeonggi-do (KR); Ho Jin Yun, Gyeonggi-do (KR); Young Seuck Yoo, Gyeonggi-do (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/052,403

(22) Filed: Oct. 11, 2013

(65) Prior Publication Data

US 2014/0218150 A1 Aug. 7, 2014

(30) Foreign Application Priority Data

Feb. 6, 2013 (KR) ..... 10-2013-0013321
Apr. 5, 2013 (KR) ..... 10-2013-0037656

(51) Int. Cl.

| | |
|---|---|
| ***H01F 5/00*** | (2006.01) |
| ***H01F 41/12*** | (2006.01) |
| ***H01F 17/00*** | (2006.01) |
| ***H01F 41/04*** | (2006.01) |

(52) U.S. Cl.

CPC ..... *H01F 41/12* (2013.01); *H01F 5/00* (2013.01); *H01F 17/0013* (2013.01); *H01F 41/046* (2013.01); *H01F 2017/0066* (2013.01); *H01F 2017/0093* (2013.01); *Y10T 29/4902* (2015.01)

(58) Field of Classification Search

CPC ..... H01F 5/00; H01F 27/00–27/36
USPC ..... 336/65, 83, 200, 232, 192
IPC ..... H01F 5/00, 27/02, 27/30, 27/28
See application file for complete search history.

(56) References Cited

U.S. PATENT DOCUMENTS

2010/0176484 A1* 7/2010 Asakura et al. ..... 257/531

FOREIGN PATENT DOCUMENTS

| | | | |
|---|---|---|---|
| JP | 2012-015494 | A | 1/2012 |
| KR | 10-2002-0008776 | A | 1/2002 |
| KR | 10-2002-0045782 | A | 6/2002 |

* cited by examiner

*Primary Examiner* — Tuyen Nguyen
(74) *Attorney, Agent, or Firm* — McDermott Will & Emery LLP

(57) ABSTRACT

Disclosed herein is a common mode filter including: a body element including an insulating member enclosing a coil electrode pattern and a magnetic member disposed on one surface or both surfaces of the insulating member; and an insulating layer disposed on at least one side of the body element, thereby increasing an interlayer adhesion between the respective components configuring the common mode filter.

10 Claims, 8 Drawing Sheets

COMMON MODE FILTER AND METHOD OF MANUFACTURING THE SAME

CROSS REFERENCE(S) TO RELATED APPLICATIONS

This application claims the benefit under 35 U.S.C. Section 119 of Korean Patent Applications Nos. 10-2013-0013321 and 10-2013-0037656 entitled "Common Mode Filter And Method Of Manufacturing The Same" filed on Feb. 6, 2013 and Apr. 5, 2013, which is hereby incorporated by reference in its entirety into this application.

BACKGROUND OF THE INVENTION

1. Technical Field The present invention relates to a common mode filter and a method of manufacturing the same, and more particularly, to a common mode filter having an insulating layer disposed on a side of an element and a method of manufacturing the same.

2. Description of the Related Art

In accordance with the development of a technology, electronic devices such as a portable phone, a home appliance, a personal computer (PC), a personal digital assistant (PDA), a liquid crystal display (LCD), and the like, have been changed from an analog scheme into a digital scheme and have been speeded up due to an increase in a data amount to be processed. Therefore, USB 2.0, USB 3.0, and a high-definition multimedia interface (HDMI) have been widely distributed as a high speed signal transmission interface and used in numerous digital devices, such as a personal computer, a high quality digital television, and the like.

Unlike a single-end transmission system generally used for a long period of time, these interfaces adopt a differential signal system that uses a pair of signal lines to transmit a differential signal (differential mode signal). However, the digitized and speeded up electronic devices are sensitive to stimulus from the outside. That is, in the case in which small abnormal voltage and a high frequency noise are introduced from the outside into an internal circuit of the electronic device, a circuit may be damaged and a signal may be distorted.

In order to prevent a circuit breakage or a signal distortion of electronic devices from occurring, a filter is mounted to interrupt the introduction of abnormal voltage and high frequency noise into a circuit. Generally, a common mode filter has been used in a high speed differential signal line, and the like, to remove a common mode noise.

The common mode noise is noise occurring at the differential signal line and the common mode filter removes noises that may not be removed by the existing EMI filter. The common mode filter contributes to improvement in EMI characteristics of a home appliance, and the like, and improvement of antenna characteristics of a cellular phone, and the like.

Referring to Japanese Patent Laid-Open Publication No. 2012-015494, a general common mode filter according to the related art has a structure in which a magnetic substrate is disposed at a lower part and an insulating layer enclosing a coil electrode is stacked thereon.

According to the above structure, one surface of the magnetic substrate and one surface of the insulating layer contact each other, forming an interface. Therefore, cracks or delaminating may frequently occur at the interface between the magnetic substrate and the insulating layer due to a difference in a material between the magnetic substrate and the insulating layer.

This is due to the bonding of heterogeneous materials having different chemical characteristics. When two members having different materials are bonded to each other, a thermal residual stress is concentrated on the bonded interface and the potential stress degrades the interlayer adhesion. Further, the contraction percentage may be different due to the difference in the thermal expansion coefficient during the firing process, such that the cracks or the delaminating may appear at the bonded interface.

The cracks or the delaminating occurring at the bonded interface may lead to facilitate the moisture permeation into the bonded interface from the outside, damage a product even by the small impact, and the like, thereby degrading the reliability of a product. Therefore, the common mode filter having excellent durability and the method of manufacturing the same are urgently needed.

RELATED ART DOCUMENT

Patent Document (Patent Document 1) Patent Document: Japanese Patent Laid-Open Publication No. 2012-015494

SUMMARY OF THE INVENTION

An object of the present invention is to provide a method of manufacturing a common mode filter which may be produced in mass while increasing an interlayer adhesion between respective components configuring a common mode filter by disposing an insulating layer around a device.

According to an exemplary embodiment of the present invention, there is provided a common mode filter, including: a body element including an insulating member enclosing a coil electrode pattern and a magnetic member disposed on one surface or both surfaces of the insulating member; and an insulating layer disposed on at least one side of the body element.

The insulating layer may be made of at least one selected from epoxy resin, phenol resin, urethane resin, silicon resin, polyimide resin, polycarbonate resin, acrylic resin, polyacetal resin, and polypropylene resin.

A thickness of the insulating layer may be 5 μm to 20 μm.

The insulating layer may include a magnetic powder.

A diameter of the magnetic powder included in the insulating layer may be smaller than that of the magnetic powder included in the magnetic member.

The common mode filter may further include a plurality of external electrode terminals connected to the coil electrode patterns through an electrode penetrating through the insulating member and disposed on any one surface of the insulating member.

The magnetic member may be formed of a magnetic substrate supporting a lower portion of the insulating member and a magnetic resin composite disposed between the external electrode terminals.

According to another exemplary embodiment of the present invention, there is provided a method of manufacturing a common mode filter, including: forming an insulating member enclosing a coil electrode pattern on a magnetic substrate partitioned into a plurality of regions, having a margin portion M formed therebetween, to form body elements for each region; performing primary cutting for individualizing the body elements of each region by removing the margin portion (M); filling an insulating resin in the margin portion M remaining as an empty space after the primarily cutting of the body elements; and performing secondary cutting of removing the margin portion M at a predetermined width from sides of each region.

The insulating resin may be made of a mixture of magnetic powder and resin.

The primarily and secondarily cutting of the body element may be performed by cutting the margin portion M with a dicing blade.

A thickness of the dicing blade used during the secondarily cutting of the body elements may be smaller than that of the dicing blade used during the primarily cutting of the body elements.

A thickness of the dicing blade used during the primarily cutting of the body elements may be 50 μm to 100 μm and the thickness of the dicing blade used during the secondarily cutting of the body elements may be 30 μm to 70 μm.

In the forming of the body elements for each region, external electrode terminals may be further formed on the insulating member through a plating process after the forming of the insulating member and a magnetic resin composite may be further formed by filling a mixed paste of magnetic power and resin between the external electrode terminals.

DESCRIPTION OF THE PREFERRED EMBODIMENTS

Various advantages and features of the present invention and methods accomplishing thereof will become apparent from the following description of exemplary embodiments with reference to the accompanying drawings. However, the present invention may be modified in many different forms and it should not be limited to exemplary embodiments set forth herein. These exemplary embodiments may be provided so that this disclosure will be thorough and complete, and will fully convey the scope of the invention to those skilled in the art.

Terms used in the present specification are for explaining exemplary embodiments rather than limiting the present invention. Unless explicitly described to the contrary, a singular form includes a plural form in the present specification. The word "comprise" and variations such as "comprises" or "comprising," will be understood to imply the inclusion of stated constituents, steps, operations and/or elements but not the exclusion of any other constituents, steps, operations and/or elements.

Figure 1:
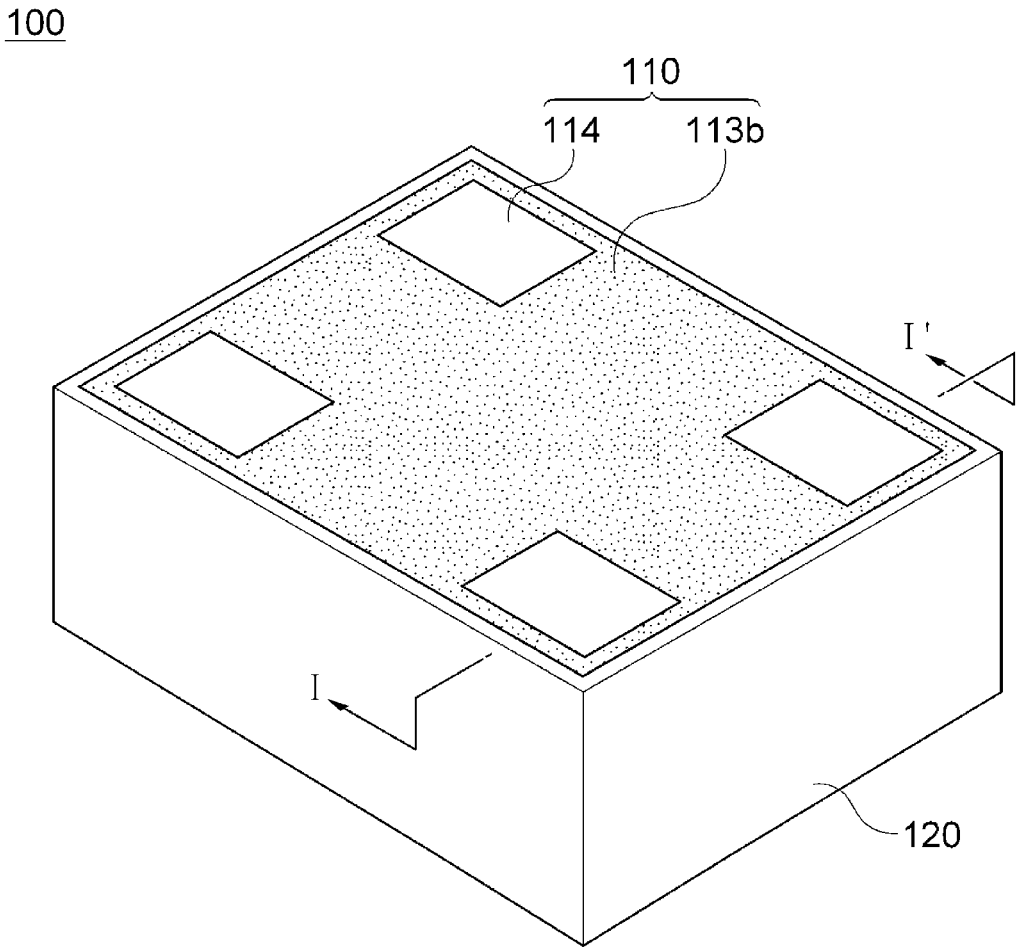
FIG. 1 is a perspective view of a common mode filter according to an exemplary embodiment of the present invention.
Figure 2:
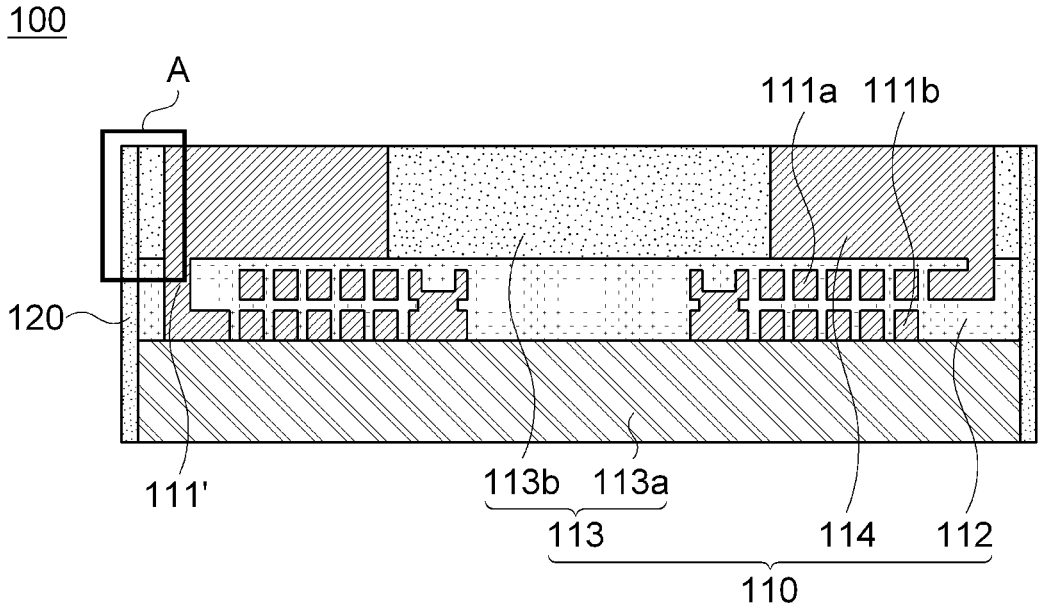
FIG. 2 is a cross-sectional view taken along the line I-I' of FIG. 1.

Referring to FIGS. 1 and 2, a common mode filter 100 according to an exemplary embodiment of the present invention may include a body element 110 and an insulating layer 120 disposed on at least one side of the body element 110.

In this configuration, the body element 110 may include an insulating member 112 enclosing coil electrode patterns 111*a* and 111*b* and a magnetic member 113 disposed on one surface or both surfaces of the insulating member 112.

The coil electrode patterns 111*a* and 111*b* may be configured of a primary coil electrode pattern 111*a* and a secondary coil pattern 111*b* that are electromagnetically coupled to each other. As illustrated in FIG. 2, the primary coil electrode pattern 111*a* and the secondary coil pattern 111*b* may be disposed in a thickness direction at a predetermined distance or unlike this, may be alternately disposed on the same plane.

The coil electrode patterns 111*a* and 111*b* are connected to external electrode terminals 114 through an electrode 111' penetrating through the insulating member 112 and the external electrode terminal 114 may be disposed on any one surface of the insulating member 112. The external electrode terminal 114 may be configured of four external electrode terminals, for example, a pair of external electrode terminals each connected to both ends of the primary coil electrode pattern 111*a* and a pair of external electrode terminals each connected to both ends of the secondary coil electrode pattern 111*b*, and the like.

The magnetic member 113 is a member that becomes a moving path of magnetic flux generated from the coil electrode patterns 111*a* and 111*b* and may be made of Fe—Ni—Cu-based, Fe—Ni—Cu—Zn-based, Mn—Zn-based, Ni—Zn-based, Ni—Zn—Mg-based, and Mn—Mg—Zn-based ferrites all of which have a small magnetic force loss and a high magnetic permeability or a mixture thereof.

Even though the magnetic member 113 may be disposed on any one surface of the insulating member 112, the magnetic member 113 may be disposed on both surfaces of the insulating member 112 to implement a smooth flow of magnetic flux. According to the exemplary embodiment of the present invention, the magnetic member 113 is configured of a magnetic substrate 113*a* that is disposed beneath the insulating member 112 to support the insulating member 112 and a magnetic resin composite 113*b* disposed between an external electrode terminals 114.

In the body element 110 having the structure according to the exemplary embodiment of the present invention, the insulating layer 120 is disposed on at least any one side of the body element 110.

Therefore, even though there is a physical interface between the insulating member 112 and the magnetic member 113, that is, between the insulating member 112 and the magnetic substrate 113*a* or between the insulating member 112 and the magnetic resin composite 113*b*, it is possible to prevent a crack or a delamination between the interfaces due to an excellent adhesion of the insulating layer 120. Further, the insulating layer 120 prevents moisture from permeating between the interfaces and protects the body element 110 from external impact, thereby greatly improving the reliability of a product.

As a construction material of the insulating layer 120 to maximize the above-mentioned effect, at least any one selected from epoxy resin, phenol resin, urethane resin, silicon resin, polyimide resin, polycarbonate resin, acrylic resin, polyacetal resin, and polypropylene resin, all of which have excellent adhesive property, heat resistance, moisture resistance, and the like, may be used. Meanwhile, when a thickness of the insulating layer 120 is too thick, it may be difficult to implement the miniaturization; however, when the thickness of the insulating layer 120 is too thin, it may be difficult to exhibit the above-mentioned effect. Therefore, the thickness of the insulating layer may be appropriately selected within a range of 5 μm to 20 μm. However, the numerical range defines an optimum value that may maximally implement the effect of the present invention. Even though the optimum value slightly deviates from the numerical range, if the optimum value is a value meeting the object of the present invention, the optimum value may be allowed.

Figure 3:
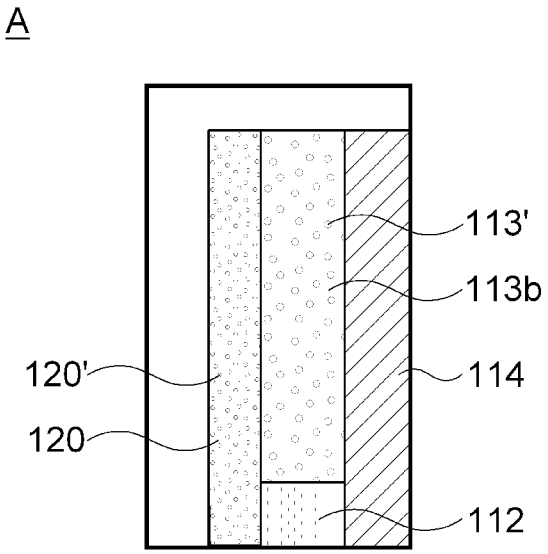
FIG. 3 is an enlarged view of the part A of FIG. 2.

FIG. 3 is an enlarged view of the part A of FIG. 2. The exemplary embodiment of the present invention has another characteristic that a magnetic powder 120' is included in the insulating layer 120.

In general, the magnetic member 113, in particular, the magnetic resin composite 113*b* formed by filling a mixed paste of magnetic powder and resin between the external electrode terminals 114 may include a magnetic powder 113' formed of coarse particles having a diameter of several tens μm in order to increase an impedance capacity per unit volume. In this case, the magnetic powder 113' particles exposed on a surface of the magnetic member 113 are separated from the surface of the magnetic member 113 during a cutting process. A void occurs on the surface of the magnetic member 113 from which the magnetic powder is separated, which leads to the degradation in impedance capacity.

However, in the case of using the insulating layer 120 including the magnetic powder 120' particles according to the exemplary embodiment of the present invention, the magnetic powder 120' particles within the insulating layer 120 is naturally incorporated into the void occurring on the surface of the magnetic member 113 in a process of disposing the insulating layer 120 on the side of the body element 110, which has an effect of compensating for the degradation in impedance capacity due to the occurrence of the void.

Similar to the magnetic powder 113' configuring the magnetic member 113, as the material of the magnetic powder 120' included in the insulating layer 120, Fe—Ni—Cu-based, Fe—Ni—Cu—Zn-based, Mn—Zn-based, Ni—Zn-based, Ni—Zn—Mg-based, and Mn—Mg—Zn-based ferrites or a mixture thereof may be used.

Further, in order for the magnetic powder 120' of the insulating layer 120 to be easily incorporated into the void, the diameter of the magnetic powder 120' included in the insulating layer 120 may be smaller than that of the magnetic powder 113' included in the magnetic member 113. For example, the magnetic member 113 uses the magnetic powder having a diameter of several tens μm, such that the insulating layer 120 may use the magnetic powder having a diameter of several μm, in more detail, a diameter of 2 to 5 μm.

Figure 4A:
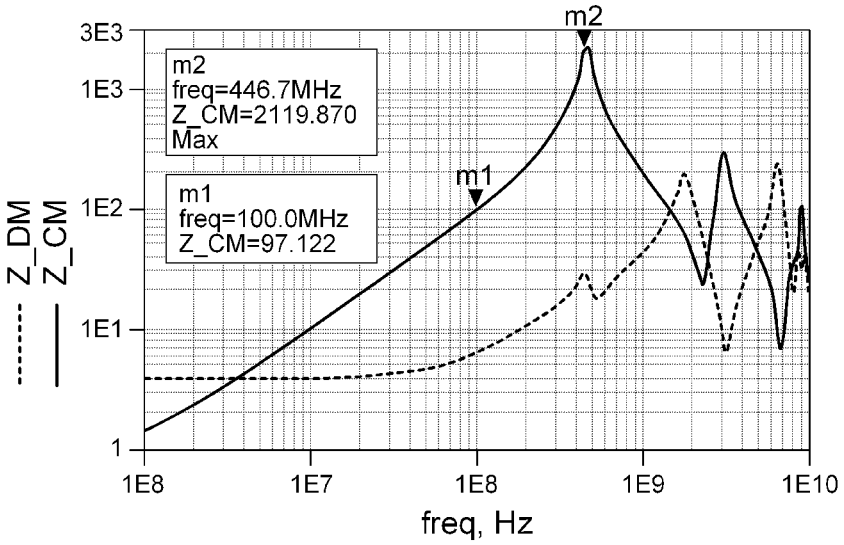
FIGS. 4A and 4B are graphs illustrating a change in characteristic values depending on a frequency in a common mode filter according to the related art.
Figure 4B:
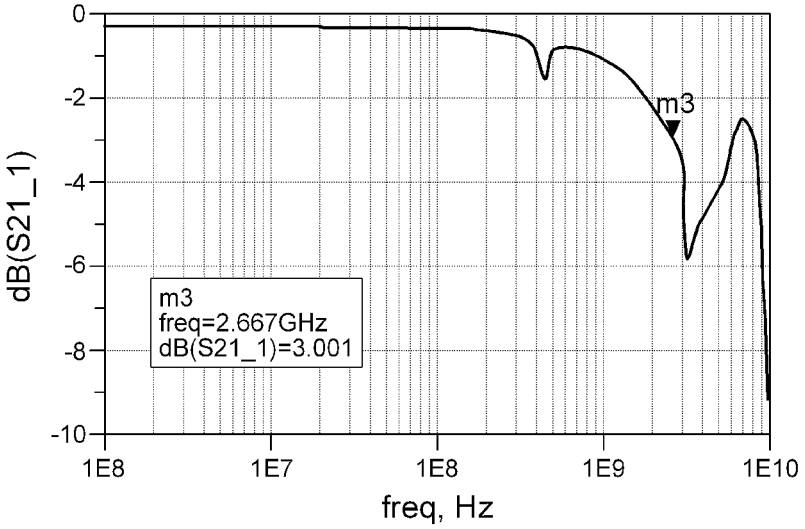
Figure 5A:
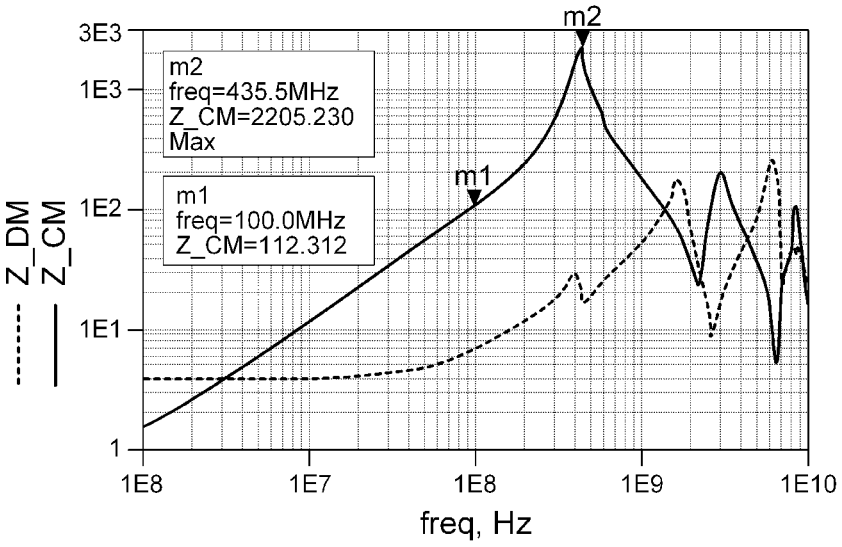
FIGS. 5A and 5B are graphs illustrating a change in characteristic values depending on a frequency in a common mode filter according to an exemplary embodiment of the present invention.
Figure 5B:
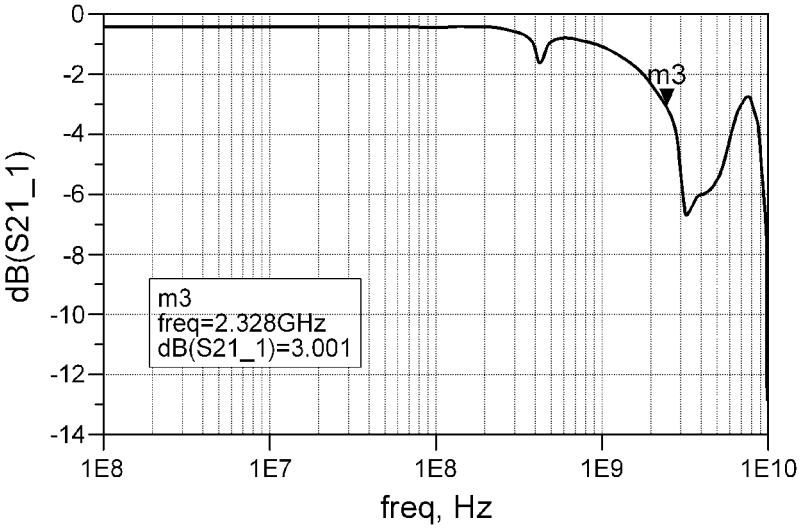

FIGS. 4A and 4B are graphs illustrating a change in characteristic values depending on a frequency in the common mode filter according to the related art which does not include the insulating layer 120 and FIGS. 5A and 5B are graphs illustrating a change in characteristic values depending on a frequency in a common mode filter according to an exemplary embodiment of the present invention.

It can be appreciated from a comparison result of FGS. 4A and 5A that the common mode filter according to the exemplary embodiment of the present invention has a common mode impedance value Z_CM higher than the related art in the same frequency band. Similarly, it can be appreciated from a comparison result of FIGS. 4B and 5B that a curve showing insertion loss characteristic further moves left in the common mode filter according to the exemplary embodiment of the present invention than the common mode filter according to the related art.

Hereinafter, a method of manufacturing a common mode filter according to the exemplary embodiment of the present invention will be described.

FIGS. 6 to 9 are process diagrams sequentially illustrating a method of manufacturing a common mode filter according to the exemplary embodiment of the present invention and are top views illustrating an appearance depending on each process.

Figure 6:
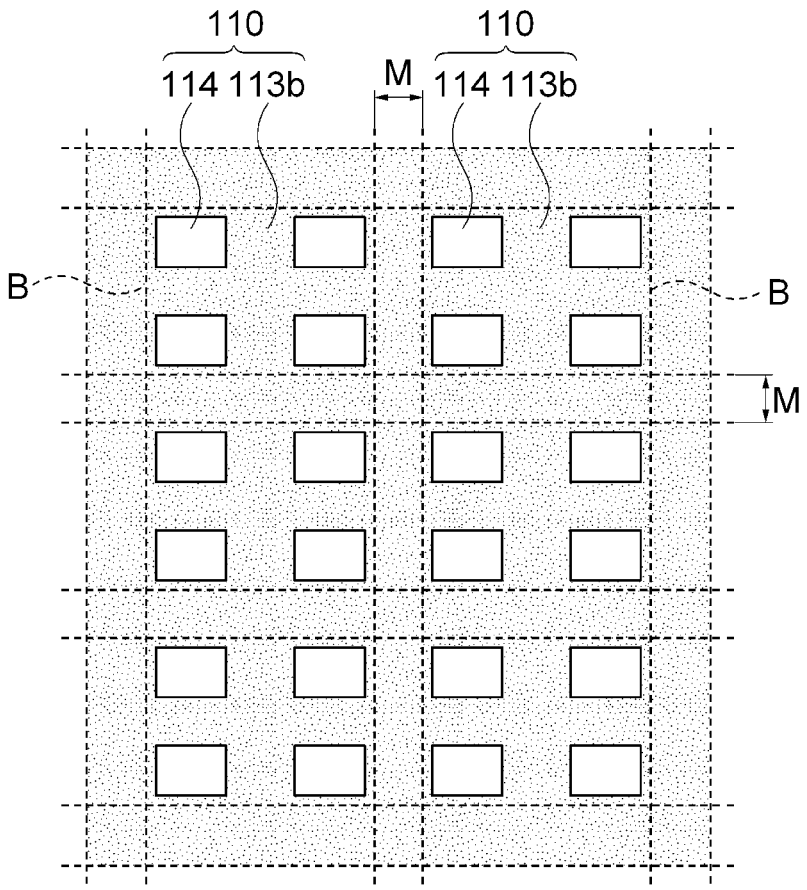
FIGS. 6 to 9 are process diagrams sequentially illustrating a method of manufacturing a common mode filter according to an exemplary embodiment of the present invention.

The method of manufacturing a common mode filter according to the exemplary embodiment of the present invention includes partitioning the magnetic substrate 113*a* having, for example, a size of about 6 inches or 8 inches into a plurality of regions B and as illustrated in FIG. 6, forming the body element 110 in each region B. In this case, a margin portion M having a predetermined width is present between the respective regions B.

In this case, the width of the margin portion M may be defined to meet a thickness of a dicing blade used in the subsequent primary cutting process and a value thereof may be approximately 50 μm to 100 μm. When the width of the margin portion M is too narrow, it is difficult to perform the cutting process and to the contrary, when the width of the margin portion M is too wide, the number of completed body elements 110 is reduced, thereby reducing the productivity. Therefore, the width of the margin portion M may be appropriately selected within a numerical range in consideration thereof.

Describing in detail the forming of the body element 110, a process of applying an insulating material and general plating processes, such as subtractive, additive, semi-additive, and the like, are repeatedly performed on the prepared magnetic substrate 113*a* to form the insulating member 112 having the primary and secondary coil electrode patterns 111*a* and 111*b* embedded therein for each region B.

In addition, the external electrode terminal 114 is formed on the insulating member 112 by the plating process and a mixed paste of the magnetic powder and the resin is filled in an empty space between the external electrode terminals 114 to form the magnetic resin composite 113*b*.

Figure 7:
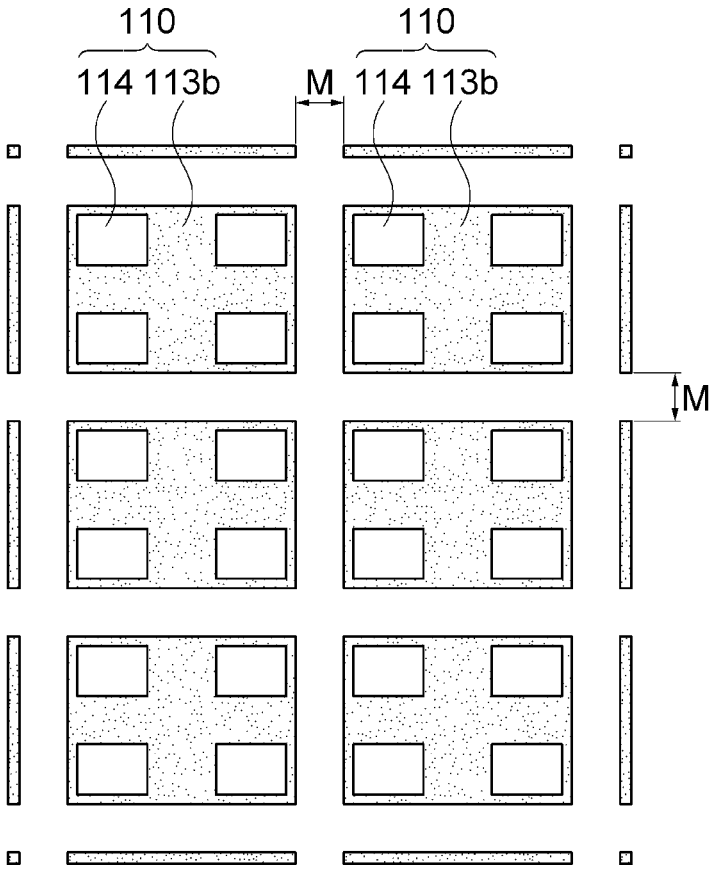

As such, when the body element is completed in each region B, as illustrated in FIG. 7, the primary cutting process of removing the margin portion M and individualizing the body elements 110 of each region B is performed.

The primary cutting process may be formed of a dicing process. Herein, the thickness of the dicing blade used in the dicing process may be selected within a range of 50 μm to 100 μm like the width of the margin portion M.

As such, when the dicing blade having the same thickness as the width of the margin portion M is used, the margin portion M is removed, such that the body elements 110 of each region B is individualized and the removed margin portion M remains as the empty space.

Figure 8:
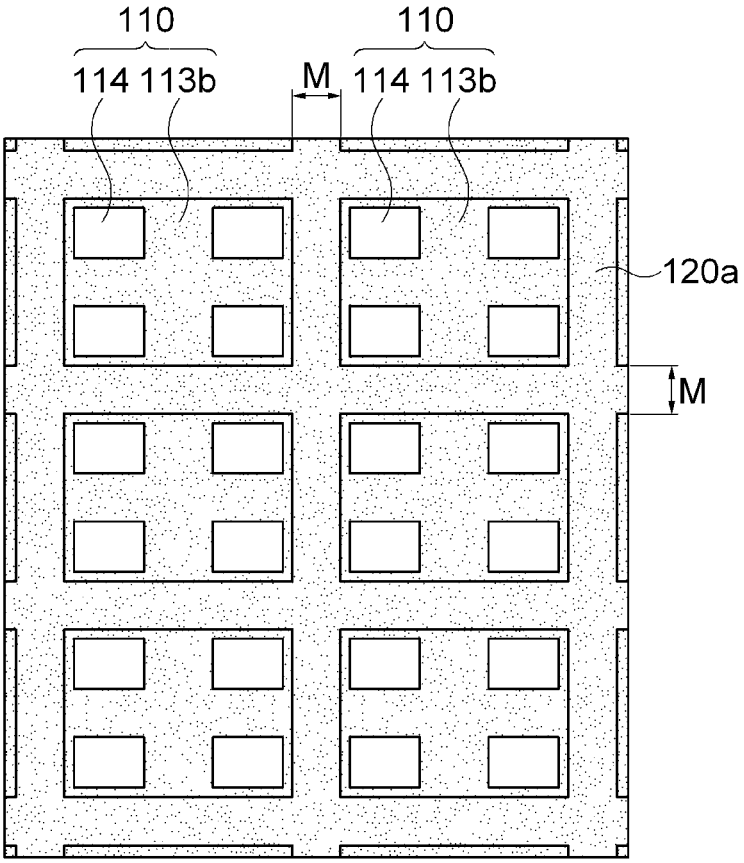

Next, as illustrated in FIG. 8, a process of filling the insulating resin 120*a* in the margin portion M remaining as the empty space is performed.

A part of the insulating resin 120*a* becomes the insulating layer 120 disposed on the side of the body element 110 after the subsequent secondary cutting process. Therefore, as a material of the insulating resin 120*a*, at least any one selected from epoxy resin, phenol resin, urethane resin, silicon resin, polyimide resin, polycarbonate resin, acrylic resin, polyacetal resin, and polypropylene resin, all of which have excellent adhesive property, heat resistance, moisture resistance, and the like, may be used.

Herein, the insulating resin 120*a* may include the magnetic powder 120' particles as illustrated in FIG. 3. Therefore, even though the void occurs on the surface of the magnetic member 113 during the primary cutting process, in the filling of the insulating resin 120*a*, the magnetic powder 120' included in the insulating resin 120*a* is naturally incorporated into the void, thereby compensating for the degradation in impedance due to the void.

Figure 9:
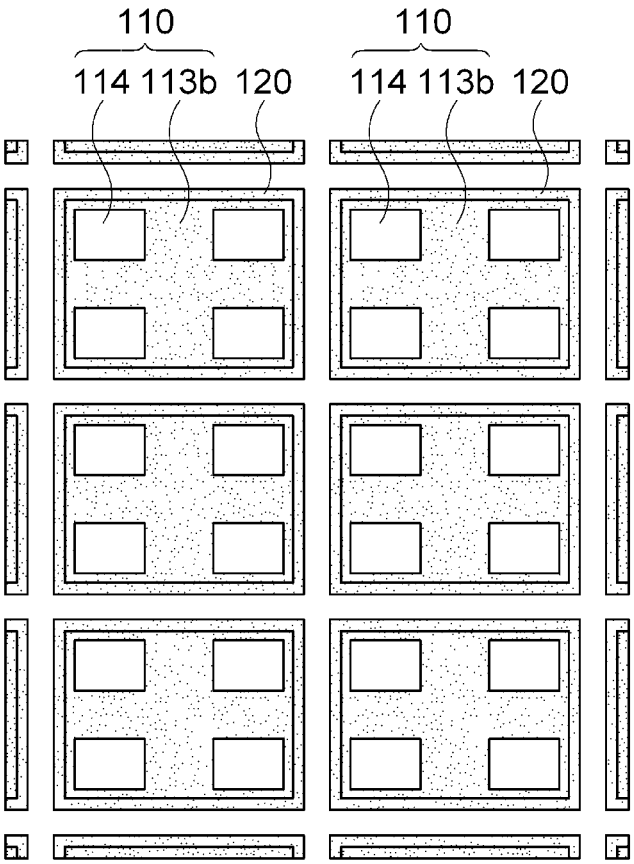

Next, finally, as illustrated in FIG. 9, the secondary cutting process of removing the margin portion M at a predetermined width from the sides of each region B is performed, thereby finally completing the common mode filter according to the exemplary embodiment of the present invention.

The secondary cutting process may be performed by using the dicing blade having a thickness thinner than that of the dicing blade used during the primary cutting process. In detail, the thickness of the dicing blade used during the secondary cutting process may be selected within a thickness of 30 μm to 70 μm.

As such, when the margin portion M is diced with the dicing blade having the thickness of the dicing blade used during the primary cutting process, that is, the thickness smaller than the width of the margin portion M, the body element 110 having the insulating layer 120 having a predetermined thickness formed thereon is re-individualized for each region B, thereby manufacturing the common mode filter according to the exemplary embodiment of the present invention.

As set forth above, with the common mode filter according to the exemplary embodiments of the present invention, the adhesion between the magnetic member and the insulating member increases by coating the insulating layer around the body element, such that the crack or delaminating phenomenon occurring at the bonded interface of the magnetic member and the insulating member can be greatly suppressed.

Further, according to the exemplary embodiments of the present invention, it is possible to fundamentally prevent the moisture from being permeated into the bonded interface between the magnetic member and the insulating member and protect the device from the external impact, thereby greatly improving the reliability of a product.

In addition, with the method of manufacturing a common mode filter according to the exemplary embodiments of the present invention, the insulating layers can be formed on the sides of the plurality of body elements in a lump, thereby greatly increasing the productivity.

The present invention has been described in connection with what is presently considered to be practical exemplary embodiments. Although the exemplary embodiments of the present invention have been described, the present invention may be also used in various other combinations, modifications and environments. In other words, the present invention may be changed or modified within the range of concept of the invention disclosed in the specification, the range equivalent to the disclosure and/or the range of the technology or knowledge in the field to which the present invention pertains. The exemplary embodiments described above have been provided to explain the best state in carrying out the present invention. Therefore, they may be carried out in other states known to the field to which the present invention pertains in using other inventions such as the present invention and also be modified in various forms required in specific application fields and usages of the invention. Therefore, it is to be understood that the invention is not limited to the disclosed embodiments. It is to be understood that other embodiments are also included within the spirit and scope of the appended claims.

What is claimed is:

1. A common mode filter, comprising:

a body element including an insulating member enclosing coil electrode patterns and a magnetic member disposed on one surface or both surfaces of the insulating member; and an insulating layer disposed on at least one side surface of the body element, wherein the at least one side surface extends in a thickness direction of the body element.

2. The common mode filter according to claim 1, wherein the insulating layer is made of at least one selected from epoxy resin, phenol resin, urethane resin, silicon resin, polyimide resin, polycarbonate resin, acrylic resin, polyacetal resin, and polypropylene resin.

3. The common mode filter according to claim 1, wherein a thickness of the insulating layer is 5 μm to 20 μm.

4. The common mode filter according to claim 1, wherein the insulating layer includes a magnetic powder.

5. The common mode filter according to claim 4, wherein a diameter of the magnetic powder included in the insulating layer is smaller than that of the magnetic powder included in the magnetic member.

6. The common mode filter according to claim 1, wherein the body element further includes external electrode terminals disposed on any one surface of the insulating member and the external electrode terminal is connected to the coil electrode pattern through an electrode penetrating through the insulating member.

7. The common mode filter according to claim 6, wherein the magnetic member is formed of a magnetic substrate formed beneath the insulating member to support the insulating member and a magnetic resin composite formed by filling a mixed paste of magnetic powder and resin between the external electrode terminals.

8. The common mode filter according to claim 1, wherein an interface is formed between the magnetic member and the insulating member and is exposed through the at least one side surface.

9. The common mode filter according to claim 8, wherein the insulating layer extends from one of the magnetic member and insulating member to the other one of the magnetic member and insulating member in the thickness direction with the interface therebetween.

10. The common mode filter according to claim 1, wherein the insulating member is made of a material different from that of the magnetic member.

* * * * *